United States Patent [19]

Humphrey

[11] 4,081,921

[45] Apr. 4, 1978

[54] ADVERTISING FOLDER

[76] Inventor: Norman J. Humphrey, 17123 Sprenger, E. Detroit, Mich. 48021

[21] Appl. No.: 755,673

[22] Filed: Dec. 30, 1976

[51] Int. Cl.[2] ..... G09F 3/04

[52] U.S. Cl. ..... 40/120; 248/459

[58] Field of Search ..... 40/124.17, 120, 107; 248/459, 460; 229/75, 92, 92.1

[56] References Cited

U.S. PATENT DOCUMENTS

| | | | |
|---|---|---|---|
| 403,604 | 5/1889 | Donnell | 229/75 |
| 1,368,859 | 2/1921 | Styll | 248/459 |
| 2,975,905 | 3/1961 | Foland | 248/459 |
| 3,079,715 | 3/1963 | Cross | 40/120 |
| 3,203,552 | 8/1965 | Stolarz | 40/120 |
| 3,226,863 | 1/1966 | Southard | 40/120 |
| 3,860,164 | 1/1975 | Dworkin | 229/75X |

*Primary Examiner*—Louis G. Mancene
*Assistant Examiner*—Wenceslao J. Contreras
*Attorney, Agent, or Firm*—Harness, Dickey & Pierce

[57] ABSTRACT

A rectangular shaped card has three score lines parallel to the short edges which divide the card into four sections for printed matter on most of the surfaces thereof. The first and second sections are disposed in inverted V-shape by inwardly disposed locking tabs to stand with the outer sides exposed. The third and fourth sections are folded upon themselves and adherred to the outside face of the second section to form a ledge between the third and fourth sections for pencils, pens and the like with the recess therebetween forming a receptacle for notes which are inserted therein.

7 Claims, 5 Drawing Figures

ADVERTISING FOLDER

SUMMARY OF THE INVENTION

A rectangular cardboard element is provided with score lines at three equally spaced points to provide four sections for folding into a predetermined relationship. The first and second sections are bent on the score line to form an inverted V-shape when a pair of tabs are extended toward each other and secured together to retain the V-form. The third and fourth sections are provided with a second score line spaced a small distance from the first score line with a slot and a tab connection at the bottom edges for retaining the two sections together in releasable relation so that the interior surfaces may be viewed for the information provided thereon. The closely spaced score lines form a ledge or tray for a pencil, pen or the like and the space therebetween forms pockets for notes covering matter which are to be acted upon in the near future. The second section has tabs extending outwardly at the side edges indicated by score lines so that they may be folded inwardly over the surface and adherred to the adjacent face of the third section which may have glue on spaced sections to have the central portion of the second and third sections adherred to each other to divide the area into a plurality of pockets for supporting the notes.

BACKGROUND OF THE INVENTION AND A RELATED APPLICATION

Reference may be had to the inventor's application Ser. No. 643,018, filed Dec. 22, 1975 for "Mailcard Portfolio" and the reference patents cited therein to show some of the existing prior art.

DESCRIPTION OF THE PREFERRED EMBODIMENT

Figure 1:
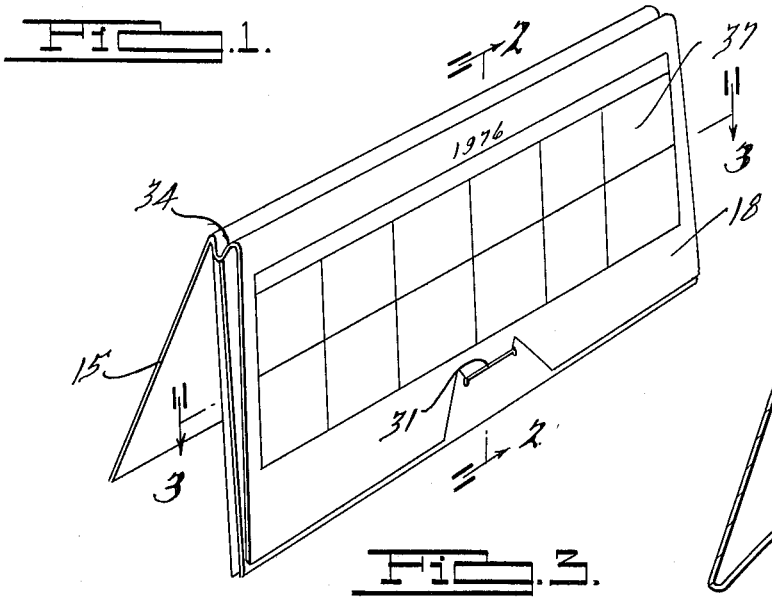
FIG. 1 is a perspective view of an advertising element embodying the present invention, illustrated in standing position.
Figure 2:
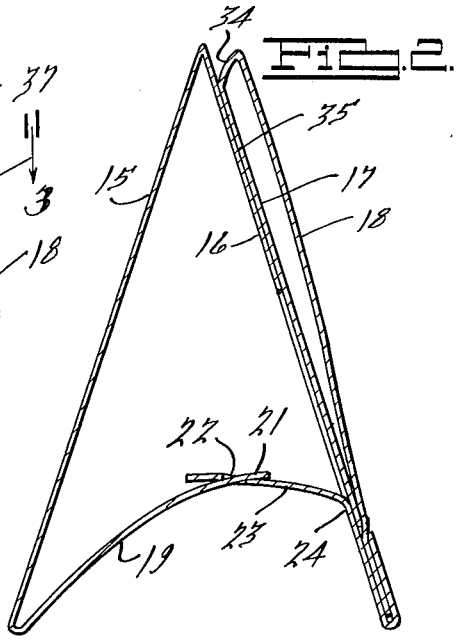
FIG. 2 is an enlarged sectional view of the structure illustrated in FIG. 1, taken on the line 2—2 thereof.
Figure 4:
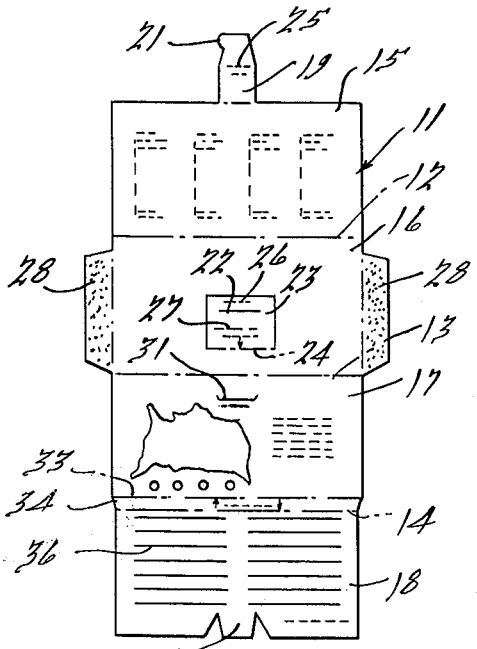
FIG. 4 is a plan view of one side of the card before being folded.
Figure 5:
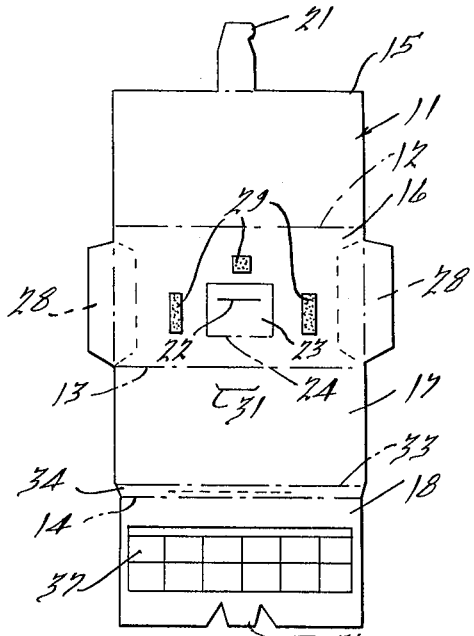
FIG. 5 is a view of the other side of the card illustrated in FIG. 4.

A cardboard element 11 is illustrated in FIGS. 4 and 5 showing the opposite faces thereto. The element is of rectangular shape and provided with score lines 12, 13 and 14 along the shorter dimension dividing the cardboard into substantially equal sections 15, 16, 17 and 18. The section 15 at one end has a tab 19 extending outwardly from the center with a locking detent 21 at the end. The detent locks within a slot 22 on a tab 23, three sides of which are cut from the section 16 leaving a fourth side 24 on which it hinges toward the section 15. Words 25 on the tab 19 state, "Insert this tab in slot B." with the slot 22 having the words 26, "Slot B" along with the wording 27 "Pull this tab outwardly and fold here.". When the tab 19 is inserted in the slot 22, the two sections 15 and 16 are in inverted V-shape relative to each other, as illustrated in FIGS. 1 and 2. The second section 16 has flaps 28 at each side edge which are scored along the edges and folded inwardly therealong, as illustrated in dot and dash line of FIG. 5. The exposed surfaces are provided with a glue which engages the adjacent surface of the section 17 which is secured thereto. Additional areas 29 on the surface of the second section 16 may be provided with glue so that the surface of the third section 17 will be secured to that of the second section 16 between the inwardly folded flaps 28 to prevent the two engaged surfaces of the sections 16 and 17 from spreading too far apart. The third section 17 has a slot 31 near the score line 13 which receives a finger 32 on the outer edge of the fourth or other end section 18.

A second score line 33 is provided in the third section 17 adjacent to the score line 14. When the fourth section 18 is folded against the third section 17 with the finger 32 extended into the slot 31, the ledge 34 extends outwardly from the third section 17, as observed more readily in FIG. 2. The ledge 34 forms a valley or tray in which a pencil, pen or the like may be placed to have it readily available for immediate use. The space 35 between the two sections 16 and 17, which are adherred together at the glued points 29, form pockets for retaining small notes which are inserted between the sections.

Figure 3:
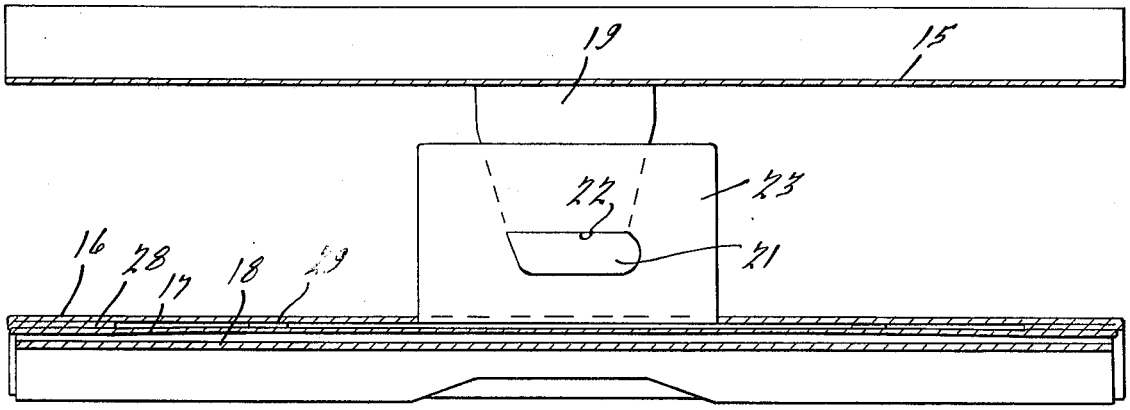
FIG. 3 is an enlarged sectional view of the structure illustrated in FIG. 1, taken on the line 3—3 thereof.

In FIG. 3, a horizontal section was taken through the assembled sections, as illustrated in FIG. 1, to show the section 15 with the tab 19 at the bottom extending inwardly and through the slot 22 of the tab 23 in locked relation therewith. The section 17 is secured by the flap 28 to the adjacent face of the section 18 with the adjacent surfaces secured together by the glued areas 29. This forms pockets between the glued areas and the flaps for the small notes referred to hereinabove. The fourth section 18 is shown spaced from the section 17 by the ledge 34 formed between the score lines 14 and 33 as illustrated in FIG. 5. The element so formed provides a handy unit for the top of the desk adjacent to a telephone. Lines 36 for names and telephone numbers of people who are called from time to time may be listed. The adjacent surface of the section 17 may have other data thereon such as an outline of the United States map with the various time zones shown thereon. These surfaces may be readily exposed by releasing the finger 32 from the slot 31 so that the section 18 may be swung outwardly and upwardly exposing the two adjacent surfaces. Similarly, the outer side of the section 18 has a calendar 37 printed thereon which is readily available for use by the person at the desk. The outer surface of the section 15 may be provided with advertisement of the entity giving the cardboard element to its customers or customers to be.

What is claimed:

1. An advertising folder embodying a cardboard sheet of rectangular form divided into four substantially equal sections by three score lines where folds are to occur, a first section has a tab extending outwardly from the edge thereof, a second section having a flap at each side edge and a tab with a slot cut therefrom aligned with the tab on said first section, a third section having a slot adjacent to said second section, and a fourth section divided by two adjacent score lines both of which are folded to form a tray when secured adjacent to said second section.

2. An advertising folder as recited in claim 1, wherein the flaps extending outwardly from the side edges of said second section are foldable inwardly to be disposed between the second and third sections, and glue on said flaps for securing the second and third sections to each other.

3. An advertising folder as recited in claim 2, wherein additional areas of glue are provided between the adjacent surfaces of the second and third sections to secure them together sufficiently to form pockets for notes disposed between the secured second and third sections along the tray area.

4. An advertising folder as recited in claim 1, wherein a finger is provided along the edge of said fourth section for projecting into a slot in said third section to releasably retain said third and fourth sections together.

5. An advertising folder as recited in claim 4, wherein said third and fourth sections may be separated to have the inner surfaces exposed so that the data printed thereon may be used and thereafter hidden when the finger is again inserted in the slot.

6. An advertising folder as recited in claim 4, wherein the tab at the edge of the first section extends into a slot in the tab of the second section to secure the sections in inverted V-relation so that the folded element will stand.

7. An advertising folder as recited in claim 4, wherein the outer faces of the first and fourth sections have exposed printed matter thereon.

* * * * *